US008245326B1

(12) United States Patent
Tolve

(10) Patent No.: US 8,245,326 B1
(45) Date of Patent: Aug. 21, 2012

(54) HELMET ADJUNCT FOR RETENTION OF PORTABLE AUDIO DEVICE

(76) Inventor: Anthony Tolve, Monroe, NY (US)

( * ) Notice: Subject to any disclaimer, the term of this patent is extended or adjusted under 35 U.S.C. 154(b) by 1115 days.

(21) Appl. No.: 12/070,739

(22) Filed: Feb. 21, 2008

(51) Int. Cl.
*A42B 1/24* (2006.01)
*B65D 85/00* (2006.01)

(52) U.S. Cl. ..... 2/422; 2/209.13; 224/181; 224/929; 224/930; 206/320

(58) Field of Classification Search ..... 2/410, 6.1, 2/6.2, 6.6, 422, 423, 425, 171, 209.13, 905, 2/906; D14/217, 192; D3/218; D29/102, D29/103; 381/376, 370, 374; 206/320, 307; 224/929, 930, 181
See application file for complete search history.

(56) References Cited

U.S. PATENT DOCUMENTS

| | | | | | |
|---|---|---|---|---|---|
| 2,117,671 | A | * | 5/1938 | Lampl | 132/315 |
| 3,192,589 | A | * | 7/1965 | Pearson | 24/452 |
| 3,215,322 | A | * | 11/1965 | Boyer et al. | 224/610 |
| 3,380,698 | A | * | 4/1968 | Goldberg et al. | 248/229.26 |
| 3,797,040 | A | * | 3/1974 | Caldwell | 2/421 |
| 3,881,639 | A | * | 5/1975 | Herip | 222/153.14 |
| 4,046,295 | A | * | 9/1977 | Eichler | 224/242 |
| 4,090,185 | A | * | 5/1978 | Patty | 340/321 |
| 4,607,395 | A | * | 8/1986 | Sundahl | 455/351 |
| 5,193,226 | A | * | 3/1993 | Mortenson | 2/422 |
| 5,353,205 | A | * | 10/1994 | Hudak | 362/105 |
| D352,706 | S | | 11/1994 | Hong | D14/137 |
| 5,450,993 | A | * | 9/1995 | Guerrero et al. | 224/246 |
| 5,581,821 | A | * | 12/1996 | Nakano | 2/422 |
| 5,624,027 | A | * | 4/1997 | Ayers et al. | 206/308.3 |
| D379,463 | S | * | 5/1997 | Richter | D14/253 |
| 5,711,469 | A | * | 1/1998 | Gormley et al. | 224/675 |
| 5,845,375 | A | * | 12/1998 | Miller et al. | 24/452 |
| 6,141,417 | A | * | 10/2000 | Lopez et al. | 379/446 |
| 6,176,401 | B1 | * | 1/2001 | Lim | 224/196 |
| 6,206,187 | B1 | * | 3/2001 | Van Winkle | 206/320 |
| 6,311,881 | B1 | * | 11/2001 | Kamiya | 224/195 |
| D454,340 | S | * | 3/2002 | Grimm | D14/240 |
| 6,497,493 | B1 | * | 12/2002 | Theisen | 362/105 |
| 6,616,294 | B1 | * | 9/2003 | Henry | 362/106 |
| 6,687,962 | B2 | * | 2/2004 | Clarner et al. | 24/452 |
| 6,732,381 | B1 | * | 5/2004 | Lal | 2/425 |
| 6,805,236 | B1 | * | 10/2004 | Caruso et al. | 206/37.1 |
| 6,978,034 | B2 | | 12/2005 | Lazzeroni et al. | 381/384 |

(Continued)

FOREIGN PATENT DOCUMENTS

DE 20110057 U1 * 8/2001

(Continued)

*Primary Examiner* — Shelley Self
*Assistant Examiner* — Jane Yoon
(74) *Attorney, Agent, or Firm* — Sandra M. Kotin

(57) ABSTRACT

A holder for an MP3 player or other music or communication device is reversibly attached to a rigid helmet such as worn by motorcyclists. The back surface of the holder is configured to fit closely and integrally against the back surface of the helmet. A spoiler forms the top of the holder to minimize wind lift, prevent wind from dislodging the holder, and to direct air flow along the helmet and over the holder. The MP3 player is disposed in a compartment within the body of the holder and retained in the compartment by a stop-tab. An adapter is used to connect the MP3 player to an earphone assembly within the helmet. A volume control on the adapter enables the cyclist to adjust the volume while riding. The holder is reversibly attached to the helmet by means of a two component heavy duty interlock fastener system.

8 Claims, 5 Drawing Sheets

U.S. PATENT DOCUMENTS

| | | | | |
|---|---|---|---|---|
| 2001/0035242 | A1* | 11/2001 | Hughs et al. | 150/154 |
| 2002/0175096 | A1* | 11/2002 | Linihan | 206/305 |
| 2003/0074721 | A1 | 4/2003 | Ma | 2/410 |
| 2004/0025230 | A1* | 2/2004 | Rainey | 2/422 |
| 2004/0188290 | A1* | 9/2004 | Sterns | 206/320 |
| 2004/0204207 | A1 | 10/2004 | Parker | 455/575.2 |
| 2004/0226079 | A1 | 11/2004 | Rainey | 2/422 |
| 2005/0072691 | A1* | 4/2005 | Schlansky | 206/232 |
| 2005/0136214 | A1* | 6/2005 | Most | 428/100 |
| 2005/0167300 | A1* | 8/2005 | Hamaguchi | 206/305 |
| 2005/0212202 | A1* | 9/2005 | Meyer | 273/108 |
| 2005/0247584 | A1* | 11/2005 | Lu | 206/320 |
| 2006/0057972 | A1* | 3/2006 | Wikel et al. | 455/90.3 |
| 2006/0162036 | A1 | 7/2006 | McCalla | 2/6.2 |
| 2006/0185062 | A1* | 8/2006 | Peng et al. | 2/209.13 |
| 2007/0165371 | A1* | 7/2007 | Brandenburg | 361/683 |
| 2007/0226876 | A1* | 10/2007 | Foust et al. | 2/171 |
| 2007/0289044 | A1* | 12/2007 | Ellis | 2/6.2 |
| 2009/0010476 | A1* | 1/2009 | Pan | 381/382 |
| 2009/0159471 | A1* | 6/2009 | Koppe | 206/242 |

FOREIGN PATENT DOCUMENTS

| | | | |
|---|---|---|---|
| KR | 2003060041 | A * | 7/2003 |

* cited by examiner

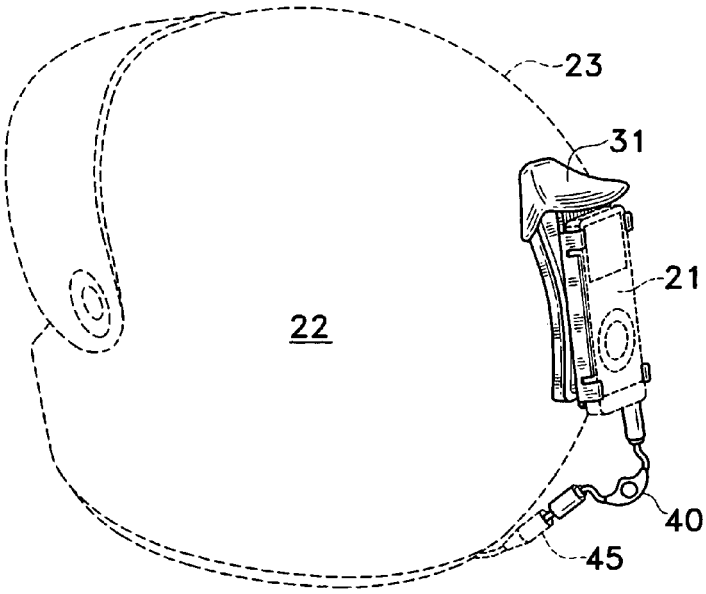
FIG. 5
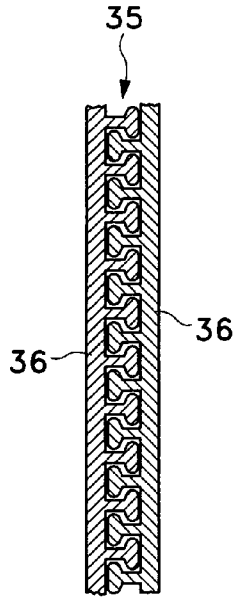
FIG. 8
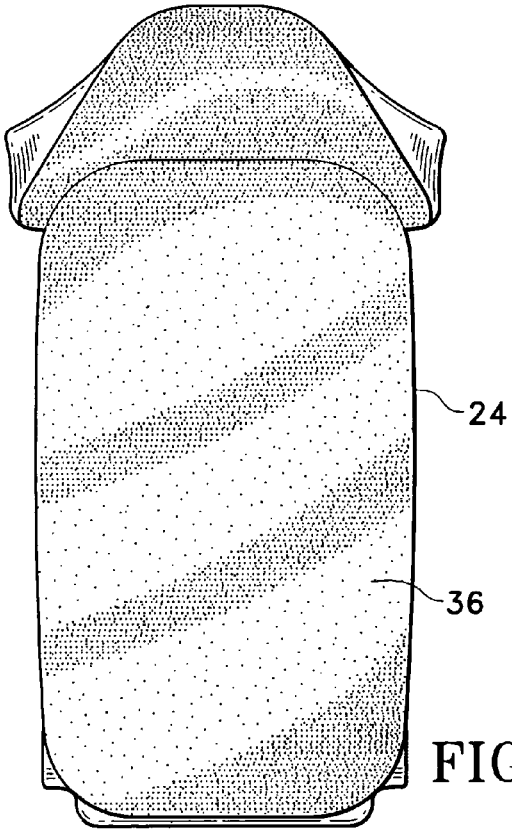
FIG. 6
FIG. 7
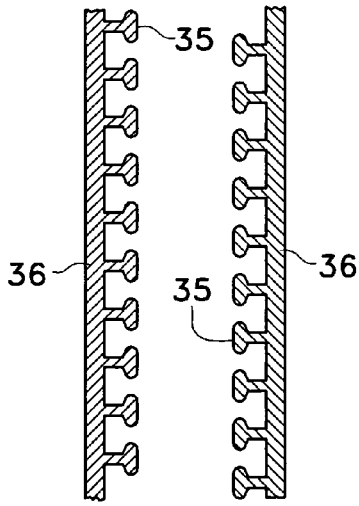

HELMET ADJUNCT FOR RETENTION OF PORTABLE AUDIO DEVICE

FIELD OF THE INVENTION

The instant invention relates to a device that attaches to a rigid helmet and is structured to reversibly hold a portable audio player.

BACKGROUND OF THE INVENTION

Communication and audio devices have been getting smaller and smaller so that they now require minimal space and can be taken anywhere. Sports enthusiasts are often out of doors for extended periods of time and want to take their audio devices with them. This is especially true of motorcycle and bicycle riders whose interactions with others is mostly visual. These sports people wear rigid helmets for extended periods of time which make communication difficult and the use of audio devices even more desirable. At first audio devices were placed in a pocket or belt holder with the wires extending from the device and laced through the user's clothing to connect to earphones within the helmet. As the audio devices have gotten smaller and easier to operate it became more practical to place the audio device on or within the helmet itself.

Hong, in design U.S. Pat. Des. No. 352,706, discloses a design for a transceiver that is mounted on the side of a helmet. It appears from FIG. 6 of the patent that the transceiver is affixed to the helmet by means of complementing protrusions that are a part of the substance of the helmet necessitating that the helmet and transceiver be made in combination. It would be difficult for the user to operate the transceiver while engaged in riding a motorcycle or bicycle. Lal teaches a sports helmet similar to those worn by bicyclists. His helmet can include a radio, an MP3 player and a cellular telephone. The communication system is built into the rigid part of the helmet and can be controlled by a remote unit. Speakers and a microphone arm are also built into the helmet. When not in use there is a pocket in the side of the helmet to contain the remote. (U.S. Pat. No. 6,732,381) To utilize this system the user would have to hold the remote, view the options and press buttons while riding a bicycle, engaging in some other activity, or stop the activity altogether.

In Patent Application Publication No. 2003/0074721, Ma shows a simple strap assembly built into the interior of a helmet to hold a mobile phone. There is no discussion as to how the phone can be used inside the helmet since no wires or other controls are shown. It would be difficult to access the controls on the phone when it is strapped to the inside of the helmet and the helmet is being worn. If the straps are merely to hold the mobile phone while not in use, it appears that it would be more comfortable to keep it in a pocket in the clothing then strapped within the helmet.

In Patent Application Publications 2004/0025230 and 2004/0226079 Rainey discloses a rigid helmet of a type worn by bicyclists. The helmet has a built-in housing in the back to hold a CD player. The housing is accessed through a cover having a transparent window and control buttons. There is also a remote control connected to the CD player by a wire. The remote contains the same control buttons as the housing so the user can operate the CD player while wearing the helmet by means of the remote or when not wearing the helmet by means of the buttons on the housing. There are also wires that go to earphones built into the helmet and a built in battery pack or a rechargeable power unit. An external compartment adjacent to the housing can hold a digital chip player but there is no information as to any wiring or controls for this component. An ambient sound sensor unit may also be present so the user can hear outside sounds. This may be controlled by an on/off switch. The helmet in this invention is manufactured with the housing and controls built into it.

McCalla discloses an attachment for a pilot's helmet designed so the pilot can reversibly affix a number of different devices to the attachment according to the operation being pursued, i.e. night vision display, tracking sensors, etc. (Patent Application Publication 2006/0162036) This attachment is not practical for sports helmets.

A method for mounting a headset assembly on a helmet is taught by Lazzeroni et al. in U.S. Pat. No. 6,978,034. This method requires that a hole be drilled in the side of the helmet through which a hollow threaded bolt is passed. Speakers and a microphone are affixed within the helmet and the device with which the head set assembly is to be used is held elsewhere on the person. Wires or a cable from the device are connected to the head set assembly through the hollow bolt. This method is for use with different types of audio communication devices.

Baseball type hats have been adapted for the incorporation of a cell phone or MP3 player. (Parker in Patent Application Publication No. 2004/0204207; Yu in Korean application No. KR2003060041A)

None of the prior art discloses a simple attachment for any rigid helmet to securely and reversibly hold a communication or audio device such as an MP3 player. None of the prior art discloses such an attachment that can easily be removed and used on another helmet. None of the prior art discloses an attachment that enhances the look of the helmet, is aerodynamically designed and enables the user to listen to music and adjust the volume while engaged in an outdoor activity. There is a need for such a helmet attachment.

BRIEF SUMMARY OF THE INVENTION

The present invention provides a holder for an MP3 player or similarly sized music or communication device. The holder can be reversibly attached to a rigid helmet such as that worn by a motorcyclist. The MP3 player is secured into the holder so that the wearer of the helmet can listen to music while riding on a motorcycle or engaging in other outdoor activities. The holder is aerodynamically designed to minimize wind lift on the helmet when the user is moving rapidly. This type of holder can also be configured to be used with a bicycle helmet or any other rigid helmet. The invention includes protection for the MP3 player in inclement weather and means to control the volume of the music.

It is an object of the present invention to provide a holder for an MP3 player to be attached to a rigid helmet and that can easily and quickly be removed therefrom.

Another object of the present invention is to provide a holder that is aerodynamically designed so wind lift is minimized and the air flow is directed along the helmet and smoothly over the holder when a user is traveling rapidly on a motorcycle, mo-ped or other such means of transportation.

A further object of the present invention is to provide a holder that can hold an MP3 player or other similar device safely and securely even when the user is traveling at high speeds.

A still further object of the present invention is to permit the user to safely control the volume of the sound while riding on a motorcycle.

It is also an object of the present invention to provide means to protect the MP3 player in inclement weather.

Another object of the present invention is to provide a holder that is easy and inexpensive to manufacture.

An object of the present invention is to provide an adapter with the holder so the MP3 player can be attached to any earphone system commonly available for use with helmets.

The invention is a holder to securely and reversibly attach a music or communication device to a rigid helmet. The holder comprises a body having a top, a bottom, a front and two side exterior surfaces and a back portion configured for integral attachment to an external surface of the helmet, a spoiler disposed at the top of the body for minimizing wind lift and directing air flow along the helmet and smoothly over the holder, a compartment within the body dimensioned to securely contain the device, and an opening situated in the bottom of the body through which the device is inserted into the compartment. There is also a slot disposed in the bottom of the body beneath the opening and extending into the body beneath the compartment, a tongue having a proximal end, a distal end and an upper surface, the distal end being attached to the body within the slot and the proximal end extending beyond the opening, a stop-tab disposed at the proximal end of the tongue at a right angle to the upper surface thereof, the stop-tab being situated in front of the opening such that when the tongue is depressed the stop-tab is no longer in front of the opening so the device can be inserted into the compartment through the opening and thereafter the tongue is released to spring upward and return the stop-tab to its location in front of the opening thereby preventing the device from being dislodged from the compartment and means for reversibly attaching the back portion of the holder to the helmet. When the holder is attached to the helmet and the device is securely contained within the compartment the user can participate in an activity while listening to the output of the device and the device cannot be dislodged during the activity.

The invention includes a holder to securely and reversibly attach a music or communication device to a rigid helmet, the holder comprising a body having a top exterior surface, a bottom exterior surface, two side exterior surfaces, a front exterior surface, and a back exterior surface portion configured for integral attachment to an external surface of the helmet, a spoiler, integral with the top exterior surface to minimize wind lift and direct air flow along the helmet and smoothly over the holder, and a compartment within body dimensioned to contain the device. There are also an opening in the body for the insertion of the device into the compartment, means for preventing the device from slipping out of the compartment, the means including a tab which when depressed allows access to the compartment and a two part interlocking attachment assembly both parts of which are identical, a first part being permanently attached to the external surface of the helmet and a second part being permanently attached to the back exterior surface portion of the body of the holder so that when the two parts are pressed together the holder is securely and reversibly attached to the helmet.

Also a part of the invention is a method for securely and reversibly attaching a music or communication device to a rigid helmet containing an interior earphone assembly. The method comprises the steps of obtaining a holder assembly which comprises a body having a top, a bottom, a front and two side exterior surfaces and a back portion configured for integral attachment to an external surface of the helmet, a spoiler integral with the top exterior surface to minimize wind lift and direct air flow along the helmet and over the holder, a compartment within the body dimensioned to contain the device, an opening in the body for insertion of the device into the compartment, means for preventing the device from slipping out of the compartment including a tab which when depressed enables access to the compartment, a two part attachment assembly having a first component for attachment to the external surface of the helmet and an identical second component for attachment to the back portion of the body of the holder to reversibly attach the back portion of the holder to the helmet, and an adapter to convey a sound signal from the device to the earphone assembly, said adapter including a volume control so the user can alter the volume of the sound signal and attaching the first component to the external surface of the helmet. Also the steps of attaching the second component to the back portion of the body of the holder, attaching the holder to the helmet by pressing the second component on the back portion of the body against the first component on the external surface of the helmet to securely and reversibly affix the holder to the helmet, depressing the tab to allow access to the compartment in the holder, placing the device into the compartment in the holder, connecting the adapter between the device and the earphone assembly within the helmet and adjusting the volume of the sound signal from the device. The user can engage in an activity while listening to the sound signal and the device will not become dislodged and at the end of the activity the device can be removed from the holder and the holder can be removed from the helmet.

Another part of the invention is a holder to securely and reversibly attach a music or communication device to a rigid helmet containing an interior earphone assembly which comprises a body having a top exterior surface, a bottom exterior surface, two side exterior surfaces, a front exterior surface, and a back exterior surface portion configured for integral attachment to an external surface of the helmet, a spoiler, integral with the top exterior surface to minimize wind lift and direct air flow along the helmet and smoothly over the holder, a compartment within body dimensioned to contain the device and an opening in the body for insertion of the device into the compartment. There are also means for preventing the device from slipping out of the compartment which includes a tab which when depressed allows access to the compartment, a two part interlocking attachment assembly having a first component permanently attached to the external surface of the helmet and a second identical component permanently attached to the back exterior surface portion of the body of the holder such that when the two parts are pressed together the holder is securely and reversibly attached to the helmet and an adapter to convey a sound signal from the device to the earphone assembly, said adapter including a volume control to enable the user to alter the volume of the sound signal while participating in an activity.

Other features and advantages of the invention will be seen from the following description and drawings.

BRIEF DESCRIPTION OF THE DRAWINGS

FIG. 5 is a perspective view of the holder containing an MP3 player and affixed to a helmet with the adapter in place;

FIG. 6 is a back plan view of the holder with the interlock layer applied;

FIG. 7 is a side sectional view of two individual layers of the interlock material;

FIG. 8 is a side sectional view of the two layers of interlock material locked together;

DETAILED DESCRIPTION OF THE INVENTION

Figure 1:
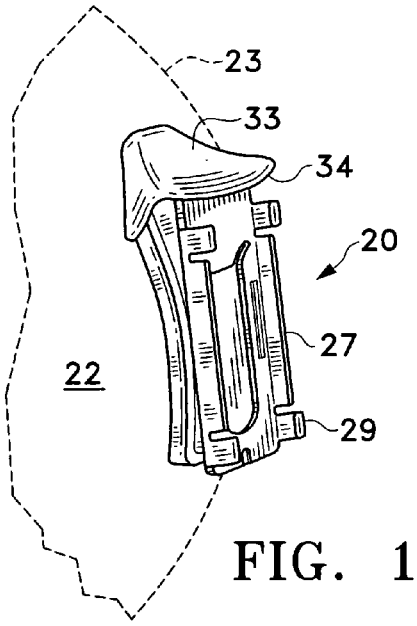
FIG. 1 is a perspective view of the first embodiment of the holder of the present invention attached to a rigid helmet.

The present invention may be a holder 20 designed to securely contain an MP3 player 21 or similar music or communication device. The holder 20 may easily be attached to a rigid helmet 22 of a type worn by motorcyclists. The holder 20 may be affixed to the external central rear surface 23 of the helmet 22 as seen in FIGS. 1 and 5 to avoid any asymmetric wind pull on the helmet. The holder 20 may be configured to minimize wind lift. The rear surface 24 of the holder 20 may be concave, seen in FIG. 3, and contoured specifically to fit integrally to the convex rear surface 23 of the helmet 22.

Figure 2:
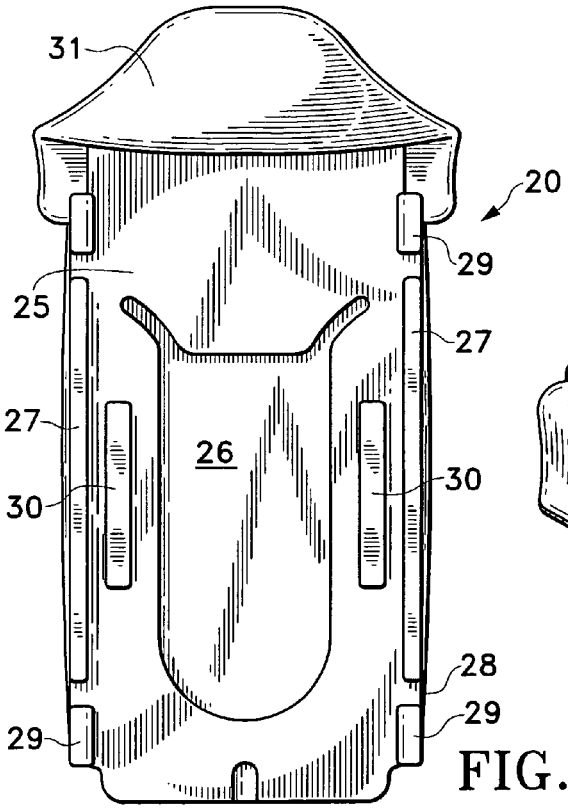
FIG. 2 is a front plan view of the holder of FIG. 1.

In contrast, the front surface or table 25 of the holder may be planar to accommodate the MP3 player 21. See FIGS. 2 and 3. The table 25 may be solid in nature, or it may have a cut out portion 26 in its surface to minimize the amount of material used to make the holder 20 and lessen its weight. The cut out portion 26 may follow a particular design or pattern for aesthetic purposes. An inward facing clip 29 may be situated at each corner of the table 25 along the longitudinal edges 28. The clips 29 may be formed integrally with the table 25 or otherwise attached thereto. The MP3 player 21 may be secured against the table 25 by these clips 29. There may be a rail 27 disposed along each longitudinal edge 28 of the table 25 between the clips 29. The two rails 27 together may function as shields to protect the sides of the MP3 player 21. The MP3 player 21 may fit substantially tightly against the rails 27 when properly seated. This tight fit may be an additional assist in insuring that the MP3 player 21 is not dislodged from the holder 20 when the user is traveling at high speeds.

To assist in forming a secure hold on the MP3 player 21, there may be two slightly raised longitudinal elevations or struts 30 on the sides of the table 25 adjacent to the rails 27 against which the MP3 player 21 may be held by the clips 29. The struts 30 and clips 29 may act as a six-point retention system and may insure a tighter hold on the MP3 player 21 than if it is pressed against the planar surface of the table 25.

Figure 3:
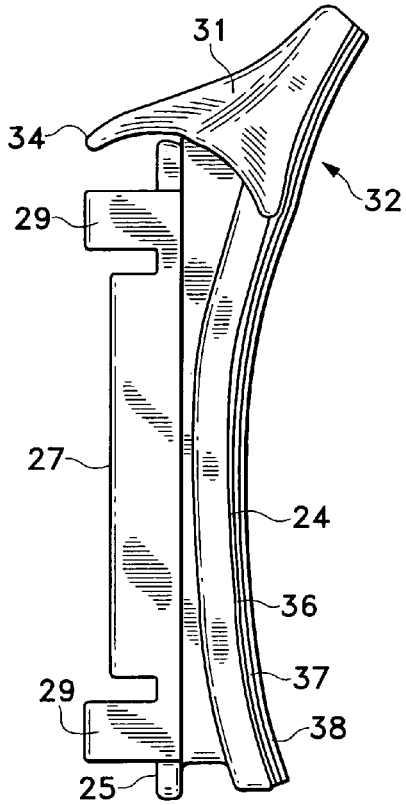
FIG. 3 is a right plan view of the holder with the two layers of interlock material and protective layer.
Figure 4:
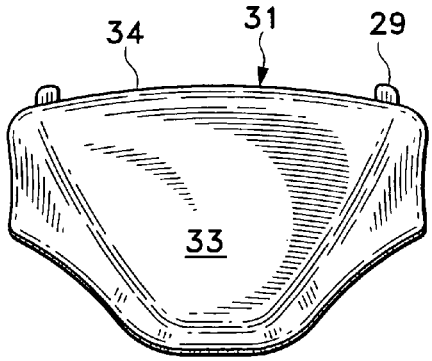
FIG. 4 is a top plan view of the holder, specifically, the spoiler.

The top portion of the holder 20 may be in the form of a spoiler 31. The rear surface 32 of the spoiler 31 may follow the contour of the back surface 24 of the holder 20, as seen in FIG. 3, while the front surface 33 of the spoiler 31 may slope downwardly and outwardly. See FIG. 4. The front edge 34 of the spoiler 31 may extend outwardly just beyond the MP3 player 21 (see FIG. 3) and may act as a cover for the top of the MP3 player 21. The spoiler 31 may direct the air flow along the helmet 22 and smoothly over the holder 20 as the user travels at high speeds and may deflect precipitation from the MP3 player 21. The spoiler 31 may also prevent wind from getting between the MP3 player 21 and the table 25 so that the force of the wind at high speeds cannot dislodge the MP3 player 21 from the holder 20.

Though the holder 20 may be permanently attached to the helmet 22 by any number of known adhesives, it may be preferable to have the attachment to the helmet 22 be reversible. The attachment may be accomplished using hook and loop fastener, but this type of fastener may not be strong enough to maintain the holder 20 in place when the user is traveling at high speeds and may not permit the holder 20 to lie close enough against the surface of the helmet 22 to prevent the wind from getting under the holder 20 and dislodging it. Additionally, when hook and loop fastener is disengaged the open surfaces tend to attach to other fabrics or materials. A heavy duty interlock fastener such as manufactured by 3M Corp. under the designation Low Profile Dual Lock fastener may provide a secure attachment as well as a low profile attachment means so the rear surface 24 of the holder 20 lies very close to the surface of the helmet 22. This material when disengaged provides a smooth surface that does not adhere to other fabrics or surfaces. The interlock material is available in sheets having the attachment means on one side and an adhesive layer on the reverse side with a peel-off shielding layer or protective cover over the adhesive.

The interlock material may have no male and female parts. Two sheets of the material may constitute the attaching surfaces which are identical. Each sheet may contain a series of mushroom-like projections 35 extending from the sheet 36 as seen in FIG. 7. When two surfaces of this material are pressed together the projections 35 interlock as seen in FIG. 8 resulting in a tight and secure closure which cannot be separated by the strong winds generated when the motorcyclist travels at very high speeds.

Two sheets of interlock material 36 may be cut to the exact dimensions of the rear surface 24 of the holder 20 as seen in FIG. 6. The peel off layer may be removed from one sheet and the adhesive surface pressed against the rear surface 24 to form a tight and permanent bond. The second sheet of the interlock material 36, cut to the same dimensions, may be attached to the helmet 22. When the holder 20 is purchased it may have the two interlock surfaces pressed together such that the three layers may be present, the interlock layer 36 that is adhered to the back surface 24 of the holder 20, the second interlock layer 37 to be applied to the rear surface 23 of the helmet 22, and the protective cover 38 over the adhesive on the second interlock layer 37. These may be seen in FIG. 3. In the alternative, the holder 20 may be purchased with the two properly cut pieces of interlock material 36 with the adhesive and protective cover in place on each piece for the user to attach to both the holder 20 and the helmet 22.

To utilize the holder 20 with the two sheets of interlock material in place, the user need only decide where on the helmet 22 he wants to place it, peel off the outer protective cover 38 and press the adhesive surface of the second interlock layer 37 against the rear surface 23 of the helmet 22. Once the adhesive has bonded to the helmet 22 the holder 20 may be securely seated. To remove the holder 20 from the helmet 22 the user may grasp it and pull forward to separate the first interlock layer 36 from the second interlock layer 37. The second interlock layer 37 may remain permanently attached to the helmet 22. The interlock material may be transparent so that it may not detract from the appearance of the helmet 22 when the holder 20 is removed. If desired, the user may place an appropriately shaped piece of the interlock material on another helmet and the holder 20 may thereafter be affixed to either helmet as the user chooses.

Figure 9:
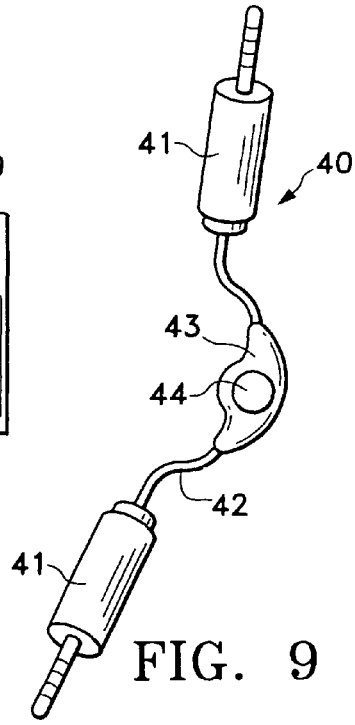
FIG. 9 is a perspective view of the adapter.

To insure that the user can hear the MP3 player 21 it may be necessary to connect it to an internal sound system. Earphone assemblies that can be installed in helmets are well known in the art and readily available in the marketplace. Once such an assembly is installed in the helmet an adapter 40, seen in FIG. 9, may be used to connect the MP3 player 21 to the earphone assembly. The adapter 40 may consist of two connectors 41, one to be inserted into a port on the MP3 player 21 and the second to be inserted into a connecting means 45 which may be a part of the earphone assembly within the helmet 22. The two connectors 41 may be attached to opposite ends of a short cable 42 that also contains a volume control unit 43 also seen in FIG. 9. The volume control unit 43 may have a volume control dial or knob 44 that may enable the user to reach behind the helmet 22 and alter the volume while riding a motorcycle. The connecting means 45 from the earphone assembly may be placed at the center of the neck portion at the bottom of the helmet 22 so the adapter need only extend from the connecting means 45 to the MP3 player 21 which may be secured in the holder 20 just above the connecting means 45. The shorter the adapter cable 42 the less chance of having it become tangled or become a problem to the wearer.

Figure 10:
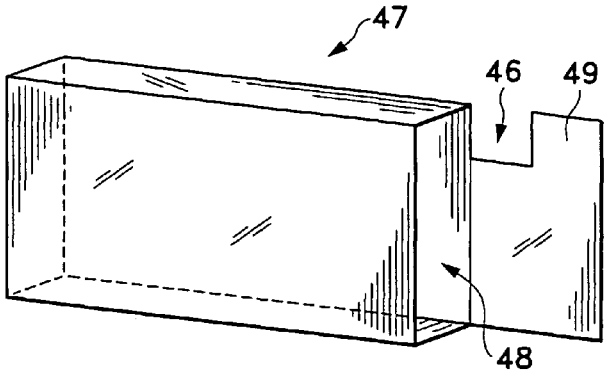
FIG. 10 is a perspective view of the protective envelope.
Figure 11:
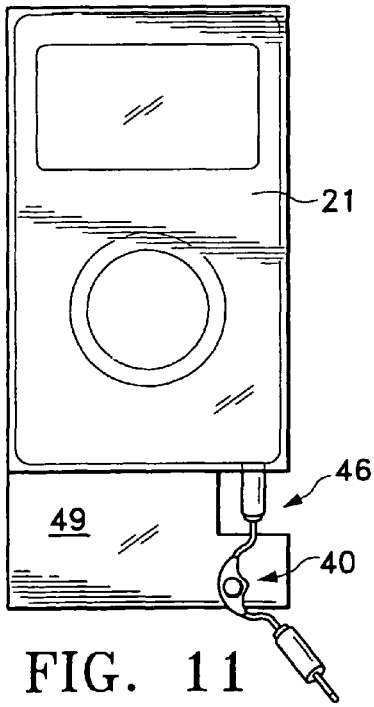
FIG. 11 is a front plan view of an MP3 player within the envelope with the tab opened and an adapter in place.
Figure 12:
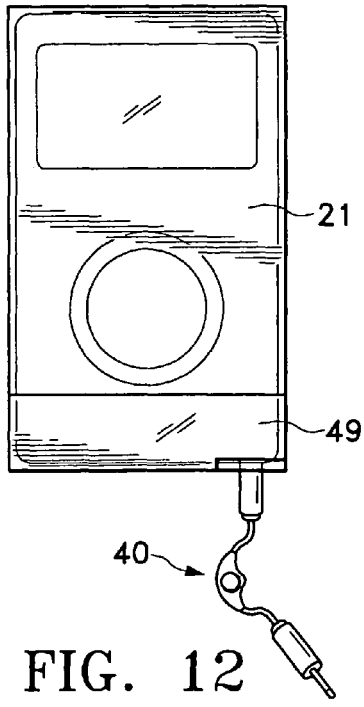
FIG. 12 is a front plan view of an MP3 player within the envelope with the tab closed and the adapter in place.

If the user chooses to be out of doors in inclement weather it may be necessary to further protect the MP3 player 21. This may be accomplished using a thin protective envelope 47 into which the MP3 player 21 may be inserted. The envelope 47 may be long and narrow and dimensioned to just contain the MP3 player 21 which my be inserted top end first into the envelope 47. The open end 48 of the envelope 47 may have an attached flap 49 integral with one edge of the open end 48. The flap 49 may be folded over the open end 48 and extended upward to completely enclose the MP3 player 21 within the envelope 47. There may be a cut out 46 in the flap 49 where it is integral with the open end 48 of the envelope 47 through which the adapter may pass. See FIGS. 10, 11 and 12. The envelope 47 may be made of a thin and flexible polymeric material and may be capable of protecting the MP3 player 21 and still permit it to be securely seated in the holder 20.

The envelope 47 may be transparent or opaque and may be of any desirable color. The holder 20 may be marketed alone, or as a three piece assembly consisting of the holder 20, the adapter 40, and the envelope 47.

Figure 13:
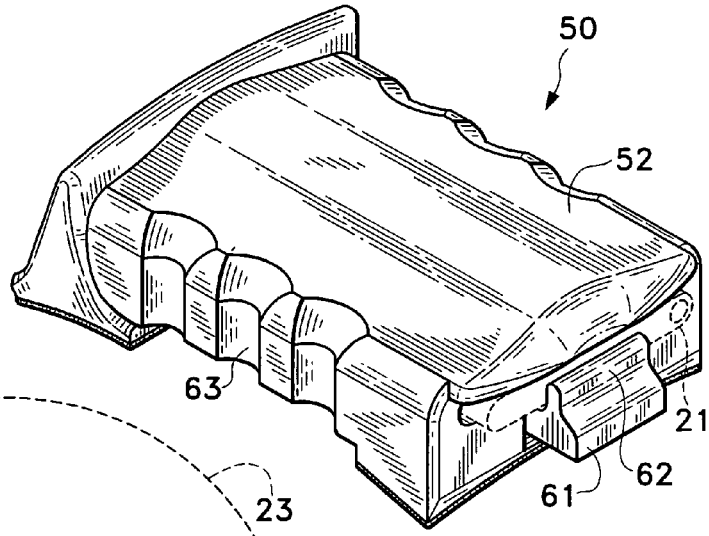
FIG. 13 is a front perspective view of a second embodiment of the holder.
Figure 14:
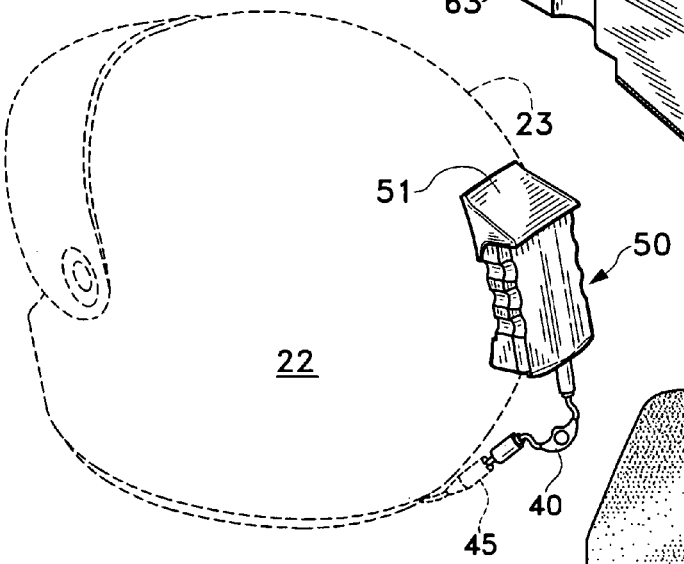
FIG. 14 is a perspective view of the second embodiment affixed to a helmet with the adapter in place.
Figure 15:
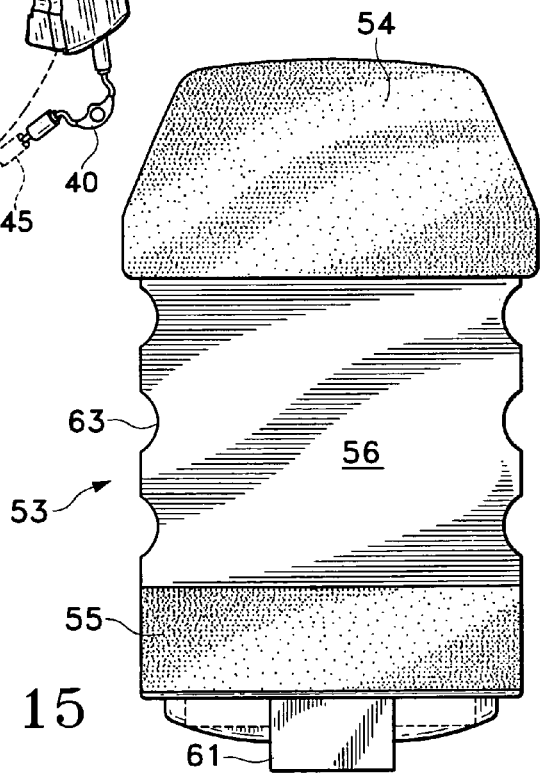
FIG. 15 is a rear plan view of the second embodiment with the interlock material applied.
Figure 16:
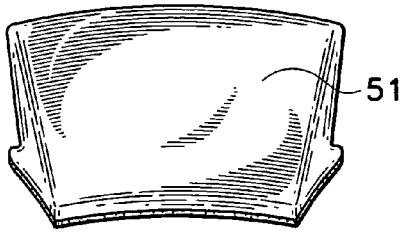
FIG. 16 is a top plan view of the second embodiment, specifically, the spoiler.
Figure 17:
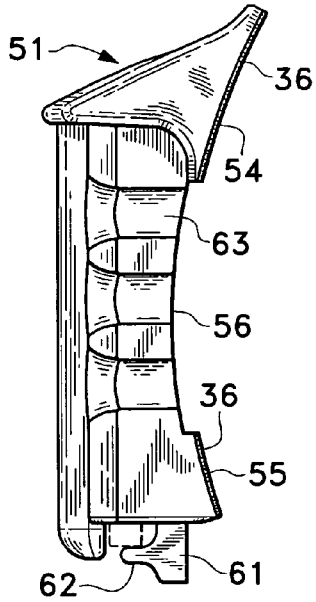
FIG. 17 is a side plan view of the second embodiment with the interlock material in place for fixation to the helmet.
Figure 18:
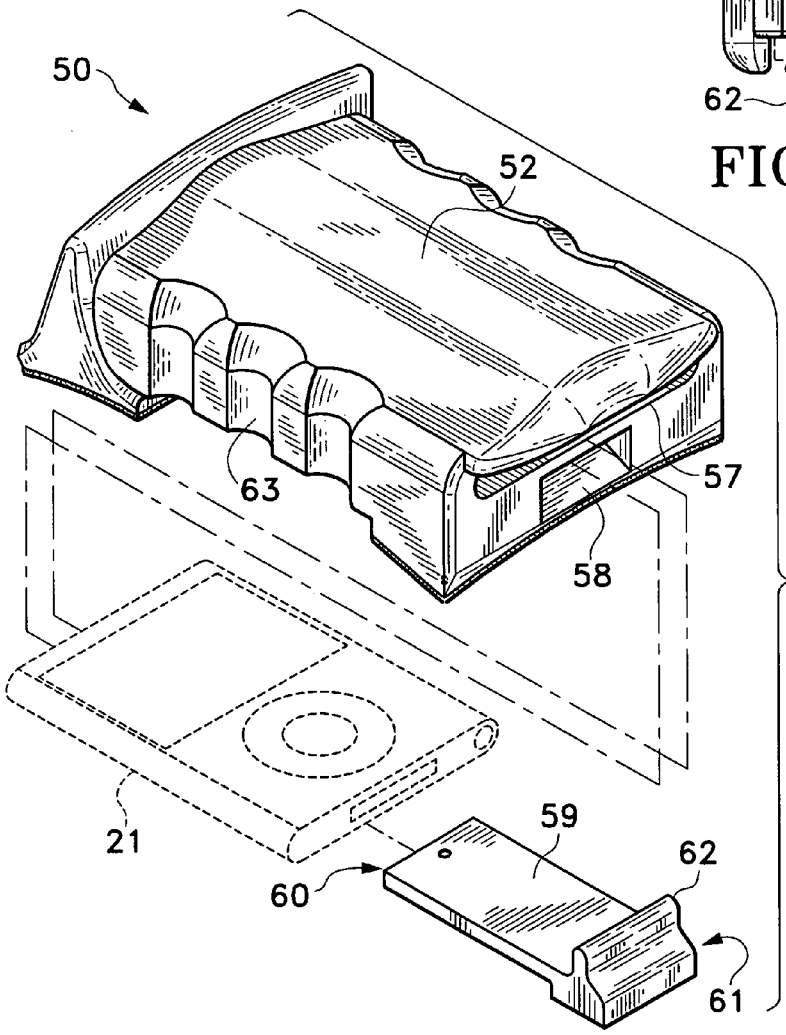
FIG. 18 is a front perspective exploded view of the second embodiment.

A second embodiment 50 of the holder may be seen in FIGS. 13, through 18. The second embodiment 50 may be designed to completely contain the MP3 player 21 within a compartment enclosed on three sides. Therefore, the front surface 52 of the second embodiment 50 may be of solid construction. This design may apportion the material in a different manner then discussed for the first embodiment of the holder 20. The rear surface 53 may be substantially solid, but the portion that fits against the helmet surface may be in two sections, a top section 54 and a bottom section 55, so the entire rear surface may not be in contact with the helmet 22. This may minimize the amount of material needed to make the second embodiment 50 and may keep it as light as possible. The same interlock material 36 may be used with the second embodiment 50, with one piece cut to fit the top section 54 of the rear surface and a second piece cut to fit the bottom section 55. This may seen in FIG. 15. The mid portion 56 of the rear surface may not come in contact with the rear surface 23 of the helmet 22, but the rear surface 53 may be substantially concave and contoured to complement the convex rear surface 23 of the helmet 22. See FIG. 17.

The top portion of the second embodiment 50 may also be in the form of a spoiler 51. Though the spoiler 51 of the second embodiment 50 may not be needed to protect the MP3 player 21, it may certainly be needed to direct air flow along the helmet 22 and smoothly over the second embodiment 50 and to minimize wind lift.

The opening 57 through which the MP3 player 21 may be inserted into the compartment may be in the bottom surface of the second embodiment 50. The opening 57 may be sized to permit the MP3 player 21 to be smoothly inserted into the compartment which may be dimensioned to just contain the MP3 player and leave no room for internal movement. There may be a slot 58 located below the opening 57 into which a tongue 59 may be disposed. The distal end 60 of the tongue 59 may be secured within the slot 58 by a screw, pin, weld or any other means known in the art. The securing point at the distal end 60 of the tongue 59 may act as a pivot so the proximal end 61 which may extend outside the slot 58 may be capable of moving downward when pressed and springing back when released. There may be a stop-tab 62 on the upper surface at the proximal end 61 of the tongue 59 set a right angle to the plane of the tongue 59. The stop-tab 62 may be situated directly in front of the opening 57 and may act as a stop to prevent the MP3 player 21 from slipping out of the opening 57. The surfaces within the compartment and within the slot 58 may all be planar. The height of the slot 58 may be greater than the thickness of the tongue 59 to permit and also to limit the up and down movement of the tongue 59 within the slot 58.

The exterior of the second embodiment 50 may be smooth or it may be designed to be more interesting in appearance. One such design may incorporate indentations 63 along both sides. In addition to enhancing the appearance of the second embodiment 50, the indentations 63 may serve as finger grips to facilitate the removal of the second embodiment 50 from the helmet 22. The second embodiment 50 may also be sold in combination with the adapter 40 to connect the MP3 player to an internal earphone assembly within the helmet 22.

Since there are two contact surfaces between the rear of the second embodiment 50 and the helmet 22, it may be more efficient to market the second embodiment 50 with the two layers of interlock material in place on the rear surfaces 54 and 55. To use the second embodiment 50 it may be affixed to the helmet 22 as previously described, by removing the protective cover from the second layer of interlock material on both surfaces 54 and 55 and applying the adhesive surfaces directly to the helmet 22 in the appropriate location. Once the adhesive has set, the second embodiment 50 may be removed as needed. To seat the MP3 player 21, the user may depress the stop-tab 62 which depresses the tongue 59 and slide the MP3 player 21, top end first, through the opening 57 and into the compartment. The pressure on the stop-tab 62 may then be released so the tongue 59 may spring upward and the stop-tab 62 may be returned to its position directly in front of the MP3 player 21 to prevent the MP3 player 21 from moving or sliding out of the opening 57. The adapter 40 may thereafter be plugged into the bottom end of the MP3 player 21 and into the connector 45 to the earphone assembly. The bottom end of the MP3 player 21 may extend beyond the opening 57 just enough so the user can grasp it for removal. However, that portion of the MP3 player 21 may be covered by the extended bottom end of the front surface 52 so that it may always be protected. (See FIG. 13)

The holder 20 may be manufactured in a single unit by injection molding, though it may also be made in parts which may be later assembled. It may be made of a plastic or other polymeric material that is substantially rigid but, may have the resiliency necessary for the clips 29 of the first embodiment to securely and reversibly grasp the MP3 player 21. The holder 20 may be specifically designed to fit compactly and integrally against the back surface of a conventional motorcycle helmet. The second embodiment 50 may also be made in one unit by injection molding, except for the tongue 59 which may be made as a second piece and later affixed at its distal end 60 within the slot 58.

The holder 20 and second embodiment 50 may be made in any desirable color or combination of colors so that the owner of the helmet 22 may select a holder 20 or 50 to complement and even improve the appearance of the helmet 22. The holder 20 and the second embodiment 50 may also be configured for use with any other rigid helmet.

While two embodiments of the present invention have been illustrated and described in detail, it is to be understood that this invention is not limited thereto and may be otherwise practiced within the scope of the following claims.

I claim:

1. A holder to securely and reversibly attach a music or communication device to a rigid helmet, said holder comprising:

a body having a top, a bottom, a front and two side exterior surfaces and a back portion configured for integral attachment to an external surface of the helmet;

a spoiler disposed at the top of the body for minimizing wind lift and directing air flow along the helmet and smoothly over the holder;

a compartment within the body dimensioned to securely contain the device;

an opening situated in the bottom of the body through which the device is inserted into the compartment;

a slot disposed in the bottom of the body beneath the opening and extending into the body beneath the compartment;

a tongue having a proximal end, a distal end and an upper surface, said distal end being attached to the body within the slot and said proximal end extending beyond the opening;

a stop-tab disposed at the proximal end of the tongue at a right angle to the upper surface thereof, said stop-tab being situated in front of the opening such that when the tongue is depressed the stop-tab is no longer in front of the opening so the device can be inserted into the compartment through the opening and thereafter the tongue is released to spring upward and return the stop-tab to its location in front of the opening thereby preventing the device from being dislodged from the compartment; and means for reversibly attaching the back portion of the holder to the helmet;

whereby when the holder is attached to the helmet and the device is securely contained within the compartment the user can participate in an activity while listening to the output of the device and the device cannot be dislodged during the activity.

2. A holder as described in claim 1 wherein the means for reversibly attaching the back portion of the holder to the helmet comprises a two component interlocking attachment assembly both components of which are identical, the first component being permanently attached to the back portion of the holder and the second component being permanently attached to the external surface of the helmet, said components providing a smooth surface when disengaged so they do not adhere to other fabrics or surfaces and said components enabling the holder to be disengaged from the helmet by being grasped and pulled forward.

3. A holder to securely and reversibly attach a music or communication device to a rigid helmet, said holder comprising:

a body having a top exterior surface, a bottom exterior surface, two side exterior surfaces, a front exterior surface, and a back exterior surface portion configured for integral attachment to an external surface of the helmet;

a spoiler, integral with the top exterior surface to minimize wind lift and direct air flow along the helmet and smoothly over the holder;

a compartment within the body dimensioned to contain the device;

an opening in the body for the insertion of the device into the compartment;

means for preventing the device from slipping out of the compartment, said means including a tab which when depressed allows access to the compartment; and a two part interlocking attachment assembly both parts of which are identical, a first part being permanently attached to the external surface of the helmet and a second part being permanently attached to the back exterior surface portion of the body of the holder such that when the two parts are pressed together the holder is securely and reversibly attached to the helmet.

4. A holder as described in claim 3 wherein the back exterior surface portion is concave for an integral fit with a convex rear surface of the helmet.

5. A holder as described in claim 3 wherein the two parts of the interlocking attachment assembly provide a smooth surface when disengaged so that they do not adhere to other fabrics or surfaces and enable the holder to be disengaged from the helmet by being grasped and pulled forward.

6. A holder as described in claim 3 further comprising an adapter to convey a sound signal from the device to an earphone assembly within the helmet and including a volume control mechanism to enable the user to alter the volume of the sound signal while the device is contained within the body of the holder.

7. A method for securely and reversibly attaching a music or communication device to a rigid helmet containing an interior earphone assembly, said method comprising:

obtaining a holder assembly which comprises:

a body having a top, a bottom, a front and two side exterior surfaces and a back portion configured for integral attachment to an external surface of the helmet, a spoiler integral with the top exterior surface to minimize wind lift and direct air flow along the helmet and over the holder, a compartment within the body dimensioned to contain the device, an opening in the body for insertion of the device into the compartment, means for preventing the device from slipping out of the compartment including a tab which when depressed enables access to the compartment, a two part attachment assembly having a first component for attachment to the external surface of the helmet and an identical second component for attachment to the back portion of the body of the holder to reversibly attach the back portion of the holder to the helmet, and an adapter to convey a sound signal from the device to the earphone assembly, said adapter including a volume control so the user can alter the volume of the sound signal;

attaching the first component to the external surface of the helmet;

attaching the second component to the back portion of the body of the holder;

attaching the holder to the helmet by pressing the second component on the back portion of the body against the first component on the external surface of the helmet to securely and reversibly affix the holder to the helmet;

depressing the tab to allow access to the compartment in the holder;

placing the device into the compartment in the holder;

connecting the adapter between the device and the earphone assembly within the helmet; and adjusting the volume of the sound signal from the device;

whereby the user can engage in an activity while listening to the sound signal and the device will not become dislodged and at the end of the activity the device can be removed from the holder and the holder can be removed from the helmet.

8. A holder to securely and reversibly attach a music or communication device to a rigid helmet containing an interior earphone assembly, said holder comprising:

a body having a top exterior surface, a bottom exterior surface, two side exterior surfaces, a front exterior surface, and a back exterior surface portion configured for integral attachment to an external surface of the helmet;

a spoiler, integral with the top exterior surface to minimize wind lift and direct air flow along the helmet and smoothly over the holder;

a compartment within body dimensioned to contain the device;

an opening in the body for insertion of the device into the compartment;

means for preventing the device from slipping out of the compartment, said means including a tab which when depressed allows access to the compartment;

a two part interlocking attachment assembly having a first component permanently attached to the external surface of the helmet and a second identical component permanently attached to the back exterior surface portion of the body of the holder such that when the two parts are pressed together the holder is securely and reversibly attached to the helmet; and an adapter to convey a sound signal from the device to the earphone assembly, said adapter including a volume control to enable the user to alter the volume of the sound signal while participating in an activity.

* * * * *